US007726163B2

(12) United States Patent
Formentin

(10) Patent No.: US 7,726,163 B2
(45) Date of Patent: Jun. 1, 2010

(54) ROLLING MONOBLOCK WITH INTERCOOLING

(75) Inventor: Roberto Formentin, Busto Arisizio-Varese (IT)

(73) Assignee: Siemens Vai Metals Technologies S.R.L., Munich (DE)

( * ) Notice: Subject to any disclaimer, the term of this patent is extended or adjusted under 35 U.S.C. 154(b) by 303 days.

(21) Appl. No.: 11/885,648

(22) PCT Filed: Mar. 13, 2006

(86) PCT No.: PCT/EP2006/002453

§ 371 (c)(1),
(2), (4) Date: Sep. 4, 2007

(87) PCT Pub. No.: WO2006/097317

PCT Pub. Date: Sep. 21, 2006

(65) Prior Publication Data

US 2008/0245123 A1 Oct. 9, 2008

(30) Foreign Application Priority Data

Mar. 16, 2005 (IT) ..... MI2005A0428

(51) Int. Cl.
*B21B 41/10* (2006.01)

(52) U.S. Cl. ..... 72/230; 72/201; 72/227; 72/250

(58) Field of Classification Search ..... 72/201, 72/202, 227, 228, 230, 234, 250
See application file for complete search history.

(56) References Cited

U.S. PATENT DOCUMENTS

| | | | | |
|---|---|---|---|---|
| 4,222,257 | A * | 9/1980 | Theis et al. | 72/201 |
| 4,909,058 | A * | 3/1990 | Bindernagel et al. | 72/201 |
| 5,345,805 | A * | 9/1994 | Hauck | 72/201 |
| 6,105,412 | A * | 8/2000 | Muller | 72/201 |
| 6,216,515 | B1 * | 4/2001 | Grimmel et al. | 72/228 |
| 6,327,885 | B1 * | 12/2001 | Marsoun et al. | 72/228 |
| 6,598,449 | B2 * | 7/2003 | Muller et al. | 72/228 |
| 2002/0104357 | A1 | 8/2002 | Muller et al. | |

FOREIGN PATENT DOCUMENTS

GB 2088764 * 6/1982

* cited by examiner

*Primary Examiner*—Edward Tolan
(74) *Attorney, Agent, or Firm*—Laurence A. Greenberg; Werner H. Stemer; Ralph E. Locher

(57) ABSTRACT

A rolling monoblock comprises: a first block (B1) of rolling stands (G1-Gm) and a second block (B2) of rolling stands (Gm+1-Gn). According to the invention, an annular path (A) of cooling of the rolled section (11) is foreseen between the two blocks (B1, B2).

6 Claims, 1 Drawing Sheet

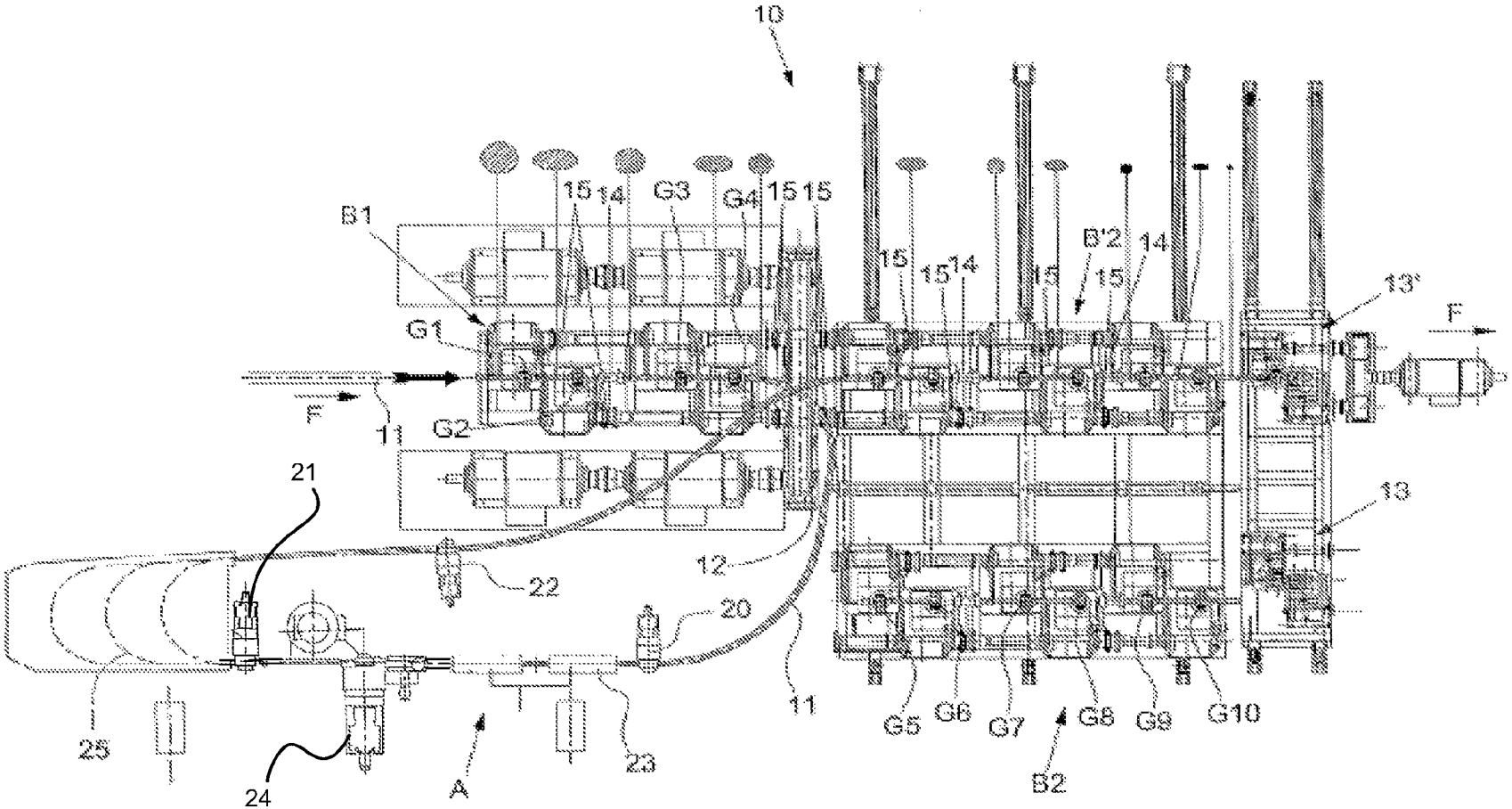
10
11
12
13
13'
14
15
B1
B2
G1
G2
G3
G4
G5
G6
G7
G8
G9
G10
F
20
21
22
23
24
25
A

ROLLING MONOBLOCK WITH INTERCOOLING

The present invention refers to a rolling monoblock with intercooling.

In a rolling plant or rolling mill for wire rods, according to consolidated technology, one works on a billet which has been previously brought to a temperature above the re-crystallisation temperature; the billet is then subjected to rolling, so to gradually reduce its section to the desired section.

In the hot-rolling of steel wires, one uses in the final rolling steps a rolling mill composed of 8-10 rolling stands, arranged one after the other, and controlled by two transmissions in turn operated by two or more motors which may be sequentially arranged.

Given the high speed of work, in order to reduce to a minimum the risks of obstructions between the stands, the same are normally arranged very close to each other, with minimum distances which may even approach 800 mm.

The plastic deformation work done on the rolled section in subsequent steps considerably increases the temperature of the rolled section itself. Between the stands, cooling devices may be prearranged.

Given however the very limited time available, due to the reduced distances between the stands and the high speeds, said coolers are not able to remove the thermal energy ensuing from the deformation work and maintain constant the temperature of the bar.

It should be considered, indeed, that the speed of the wire entering the 1st stand may be estimated to be 10-20 m/s, and such speed upon exiting is comprised between 60-100 m/s.

In such conditions, even soft steel with a low carbon content, which requires little deformation work, entering the 1st stand at 950° C. will exit the 10th stand with a temperature of 1100-1150° C., considering a final speed of 100 m/s.

With such a high rolling temperature, in the final steps, metallurgical structures are produced inside the rolled section which are not suitable for the subsequent direct uses of the rolled section thus obtained.

In the above-indicated conditions, coarse pearlitic structures may easily be found inside the rolled bar, as may bainitic or even martensitic structures, which require complex thermal cycles before the final use. On the other hand, it is known from thermomechanical rolling that rolling at lower temperatures, comprised between about 750 and 900° C., the product obtained with all types of steel has a completely pearlitic structure with thin cementite layers, particularly adapted for wire drawing or cold deformation without requiring particular thermal treatments before the final use.

General object of the present invention is that of foreseeing rolling systems and plants which permit controlling the temperature of the rolled section, especially in the final steps.

With the aforesaid objects, according to the present invention, it has been thought to make a monoblock having the characteristics set forth in the claim.

The characteristics and advantages of the present invention with regards to the prior art will be clearer and more evident from an examination of the following description, referred to the attached FIGURE which schematically illustrates an intercooled monoblock.

BRIEF DESCRIPTION OF THE DRAWINGS

With reference to the FIGURE, a rolling monoblock 10 with intercooling, object of the present invention, comprises a first block B1 and a second block B2, and is equipped with main controls 12 set between the two blocks B1, B2.

The monoblock is generally composed of 8 or 10 stands, but may also have a lower or higher number.

In the case shown, considering the rolling direction F of a product 11, the first block B1 comprises four rolling stands G1-G4 while the second block B2 comprises six stands G5-G10.

Moreover, the second block B2 is mounted on a moving cart, on which a second alternative block B'2 is present for a rapid exchange of the stand series of the second block.

Each of the two second blocks B2 and B'2 is equipped at the leaving portion with a calibrator, 13 and 13' respectively.

In both blocks, moreover, coolers 14 foreseen along with disconnectable joints indicated with 15.

As a rule, the two blocks B1 and B2 are therefore foreseen with the first block comprising G1-Gm stands, the second block comprising G(m+1)-Gn stands, with m preferably but not exclusively equal to 4 and n preferably and not exclusively equal to 8 or 10.

Such blocks B1 and B2 are arranged with one upstream and one downstream from the main controls.

Between the first and the second block, the rolled section 11 follows an annular path A of length such to be able to carry out an appropriate cooling to the desired values, with related equalisation of the temperature inside the bar so to roll at a controlled temperature in subsequent steps.

In the annular path A, the following devices are foreseen in sequence in the rolling direction F:

- a first drawing mechanism 20 whose role is to keep The rolled section 11 in tension at the exit of the first block B1 and to allow it to pass through coolers 23 to so to cool the entire rolled section, including the head;
- shears 24 for cutting the head of the cooled rolled section, so to not have obstructions at the entrance to the subsequent stand;
- a second drawing mechanism 21 whose role is to keep The rolled section in tension at the exit of the shears or cooler. In particular, such second drawing mechanism is prearranged so that when this second drawing mechanism 21 draws the rolled section 11, the first drawing mechanism 20, placed before the cooler 23, is opened and does not draw the rolled section.
- a circular loop 25 which permits avoiding tensions on the rolled section during the passage between the two blocks. The circular loop 25 is realised so to guide the material during the passage of the first part of the rolled section and subsequently open so to allow the rolled section to be free to extend in relation with its actual length between the blocks;
- a third drawing mechanism 22 placed between the circular loop 25 and the second block B2 whose role is to ensure the entrance to the second block. When the rolled section is engaged on the second block, this third drawing mechanism 22 opens and the rolled section is drawn by the stand itself.

If coolings are not foreseen inside the block, there develops a temperature increase on the first block B1 of stands of about 15° C. for each stand. However, the rolled section partially cools at the exit of each stand thanks to irradiation. In particular, at the exit of the stands which produce the rod in the oval-round calibration combination, a cooling device is foreseen which reduces the temperature 3-40° C. while still in the first block.

If one considers a temperature at the entrance of the first block B1 of 880° C., one obtains a temperature at the exit of the same, i.e. after 4 stands and at the entrance of the loop A, of about 945-950° C. Subsequently, along the annular path A, the rolled section is cooled with the coolers 23 to a temperature such that with the subsequent heating following the deformation in the second block B2, the final steps are attained at the desired temperature, less than 900° C.

The invention claimed is:

1. Rolling monoblock comprising:

a first block of rolling stands and a second block of rolling stands;

an annular path being provided between said rolling stands for cooling of a rolled section, said annular path sequentially including the following devices in a rolling direction:

a first drawing mechanism for keeping the rolled section under tension at an exit of said first block;

a cooler configured for cooling an entirety of the rolled section provided from said first drawing mechanism;

shears for cutting a head of the rolled section;

a second drawing mechanism configured for tensioning the rolled section at an exit of said cooler;

a circular loop for avoiding tensions on the rolled section during passage between said blocks; and a third drawing mechanism upstream of said second block in the rolling direction, said third drawing mechanism configured for ensuring entrance of the rolled section into said second block.

2. Monoblock according to claim 1, wherein said second drawing mechanism is prearranged so that when drawing the rolled section, the first drawing mechanism is opened and does not draw the rolled section.

3. Monoblock according to claim 1, wherein said circular loop is constructed to guide the rolled section during the passage of a first part of the rolled section and subsequently to open to allow the rolled section to be free to extend in relation with an actual length between the blocks.

4. Monoblock according to claim 1, wherein said third drawing mechanism is constructed to be open when the rolled section is engaged on said second block, so that the rolled section is drawn by a first stand of said second block.

5. Monoblock according to claim 1, wherein said first block includes m stands with m=4 and said second block includes n−m stands with n=8 or n=10.

6. Monoblock according to claim 1, wherein said circular loop is prearranged to realize an equalization of the temperature inside the bar, so to be able to roll at a controlled temperature in the subsequent steps.

* * * * *